United States Patent [19]

Wood

[11] 4,137,994

[45] Feb. 6, 1979

[54] CONSTANT LEVEL SCAFFOLD ADAPTED FOR USE WITH A TILT BED TRUCK

[76] Inventor: Donald Wood, R.R. 1, Sidney, Nebr. 69162

[21] Appl. No.: 878,258

[22] Filed: Feb. 16, 1978

[51] Int. Cl.[2] ..... E04G 1/18

[52] U.S. Cl. ..... 182/2; 182/63; 182/141; 280/6 R

[58] Field of Search ..... 182/2, 63, 127, 141, 182/148; 280/6 R

[56] References Cited

U.S. PATENT DOCUMENTS

| | | | |
|---|---|---|---|
| 2,706,102 | 4/1955 | Cresci | 182/141 |
| 3,768,591 | 10/1973 | Stucky et al. | 182/141 |
| 3,826,334 | 7/1974 | Spillman | 182/2 |
| 3,893,540 | 7/1975 | Beucher | 182/2 |

*Primary Examiner*—Price C. Faw, Jr.
*Assistant Examiner*—Conrad L. Berman
*Attorney, Agent, or Firm*—Bernard G. Fehringer

[57] ABSTRACT

A versatile, low cost scaffold is constructed of commonly available materials and is adapted to be placed upon the bed of a tilt bed truck. When thereupon placed, the platform of the scaffold remains level as it is raised by tilting the bed of the truck. The scaffold comprises a lower portion which rests upon and is securely fastened to the bed of the truck. An upper portion, which includes the platform and safety rails of the scaffold is connected to the lower portion on one side by means of a hinge.

7 Claims, 3 Drawing Figures

CONSTANT LEVEL SCAFFOLD ADAPTED FOR USE WITH A TILT BED TRUCK

FIELD OF THE INVENTION

This invention relates to a novel scaffold which is used with a tilt bed truck to provide a portable, elevatable scaffold which uses a commonly available truck to raise the constantly level scaffold.

BACKGROUND OF THE INVENTION

Scaffolds are as much a part of the construction industry as the hammer. The main drawback to scaffolds is that in order to be strong enough to safely support men and equipment, they must be bulky and heavy. This, of course, means that erecting and moving scaffolds is a time consuming and, because of ever-increasing labor costs, an expensive process. What is needed is an easily movable, yet strong and safe scaffold. The invention described herein meets this need very nicely.

DESCRIPTION OF THE INVENTION

The present invention provides a mobile, elevatable scaffold adapted for mounting on a tilt bed truck. The scaffold unit need not be designed to fit a particular truck or chassis and is easily removed to allow the truck to be used for other purposes. Furthermore, the invention is constructed from inexpensive, commonly available structural components and does not require any specially designed tension or compression beams or the like.

The scaffold is of an open frame design which allows the truck bed to be used to carry tools, materials and the like to and from job sites. The items can then be moved onto the scaffold platform or off-loaded and the scaffold used for its intended purpose during the working day.

By using the embodiments of this invention, the hydraulic cylinder(s) and pump usually standard equipment on a tilt bed truck do not need to be supplemented by additional costly pumps and cylinders thereby reducing the cost of the scaffold unit as well as the maintenence requirements.

The advantages of the present invention will become more apparent upon reference to the following specification, appended claims, and drawings wherein:

Figure 1:
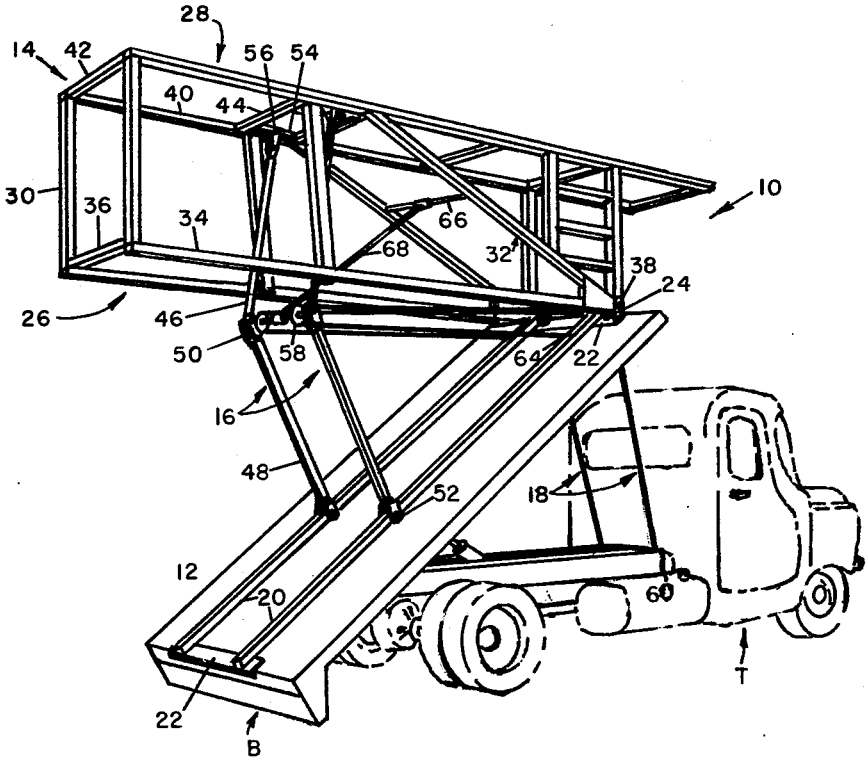
FIG. 1 is a perspective view of a constant level scaffold constructed in accordance with the present invention and shown mounted on a tilt-bed truck.

Referring now to the drawings, particularly to FIG. 1, there is illustrated a constant level scaffold generally designated 10 mounted on a truck T (shown in phantom) carrying a tilting bed B shown in a tilted position. Scaffold 10 comprises a base support structure generally indicated 12 to which is pivotally attached on the front end, a scaffold platform generally indicated 14 which is shown supported in an elevated, level position by centrally hinged compression members generally indicated 16 which are actuated and operated on by cables generally indicated 18. Base structure 12 includes a pair of laterally spaced side frames 20 and end spacers 22, end spacers 22 being suitably secured to the truck bed B. In the embodiment illustrated in the drawings, the forward end of the base support structure 12 terminates in a hub 24 (best illustrated in FIG. 2) for pivotally attaching the scaffold platform 14 hereinafter described.

Scaffold platform 14 comprises a lower frame generally indicated 26, an upper frame generally indicated 28, vertical spacers generally indicated 30, and diagonal braces generally indicated 32. Lower frame 26 includes a pair of laterally spaced side frames 34 and end spacers 36. Lower frame 26 is pivotally coupled at its forward end about pins 38 received in hubs 24 on base structure 12. Upper frame 28 includes a pair of laterally spaced side frames 40 and end spacers 42. The length of spacers 42 is selected such that side frames 40 are wider than side frames 20 so that the scaffold platform 14 may rest on the truck bed and so that the centrally hinged compression members 16 may act directly on side frames 20. Since the upper frame 28 carries a surface on which men stand and walk and on which materials may be placed, additional cross spacers are placed as needed between side frames 40 including cross spacers 44, the function of which is discussed below. Vertical spacers 30 separate upper frame 28 from lower frame 26 by a distance dictated by factors discussed below. These vertical spacers 30 can also perform ancillary functions such as providing support for steps from the truck bed to the top of scaffold platform 14. Diagonal braces 32 provide structural strength between the pivotal coupling at hubs 24 and pins 38 and the structural area around cross spacers 44.

To raise the front of the scaffold platform 14 relative to the ground, truck bed B is tilted. To likewise raise the rear end of the scaffold platform 14 and thereby maintain the scaffold platform 14 level, centrally hinged compression members 16 are provided. These members 16 comprise an upper section 46 and lower section 48 which are pivotally coupled by hubs and a shaft at point 50. Lower section 48 is pivotally coupled to side frames 20 by hubs and pins at point 52. Upper section 46 is pivotally coupled by hubs and pins at point 56 to lateral spacers 54 attached to cross spacers 44. The distance between lateral spacers 54 is equal to the distance between side frames 20. The sections 46 and 48 of compression members 16 are adapted and arranged such that pivot point 50 is located more distant from hubs 24 than are pivot points 52 and 56. Sheaves 58 are located on and rotate about the shaft at point 50. Cables 18 are provided which are attached to the truck chassis at points 60. From this attachment point 60, cables 18 pass over sheaves 62 shown in FIGS. 2 and 3, bending rearwardly to and around sheaves 58 and therefrom forward to attachment points 64 on side frames 20. Sheaves 62 may be single or double as required. Their purpose is to prevent chaffing of the cable and truck bed which would lead to premature failure of the cables.

Attachment points 64 can be varied forwardly and rearwardly on side frames 20 to adjust for the slope of the terrain on which the truck is parked. A more forward attachment would be used if the rear of the truck is lower than the front of the truck and conversely, a more rearward attachment is used if the rear of the truck is higher than the front. Also, within the flexing limits of the structural members of the scaffold, the attachment points 64 need not be the same distance from hubs 24 on both side frames 20 to allow for the ground sloping downward on one side of the truck or the other. Thus compound angles can be obtained for the scaffold platform relative to the truck chassis to provide a level working surface. For ease of rapid change of the attachment points, several eyes can be provided along the length of each side frame 20 and the ends of the cables can be provided with snap or bolt shackles.

Vertical spacers 30 separate upper frame 28 from lower frame 26. The length of these vertical spacers is dictated by two factors. One factor is the height above the truck bed desired for the top of scaffold platform 14. The other and more important factor is the reduction in strain on the compression members 16 provided by not having an extremely acute angle between the upper and lower portions of the compression members when the scaffold is in the lowered position.

For a standard tilt bed truck having a 14 to 16 foot bed, a length of 3 to 4 feet for the vertical spacers has been found to be satisfactory. In addition, this height locates the top of the scaffold platform above the top of the truck cab, thus allowing the scaffold platform to be extended over the cab providing additional work space.

As the length of the vertical spacers 30 is varied to meet the specific requirements of the uses intended for the scaffold, the length of the upper and lower portions of the centrally hinged compression members must be varied also to maintain the scaffold platform level as the truck bed is raised. The length of the compression members can be determined by one skilled in the art using trigonometric calculations or by experimentation.

Figure 2:
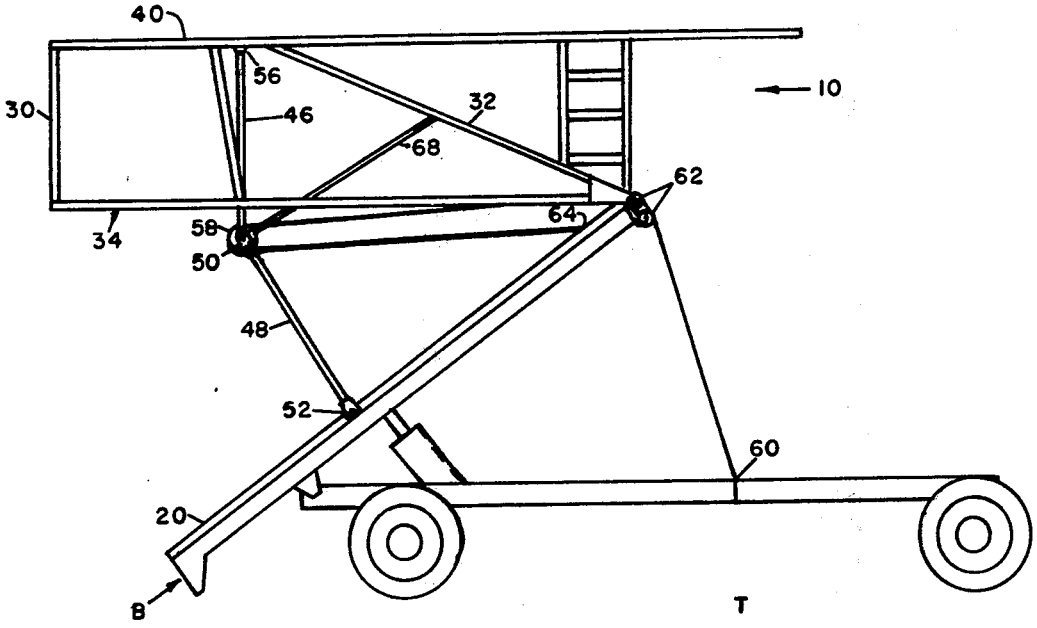
FIG. 2 is a side elevational view of a constant level scaffold constructed in accordance with the present invention and shown mounted on a truck chassis carrying a tilting bed.
Figure 3:
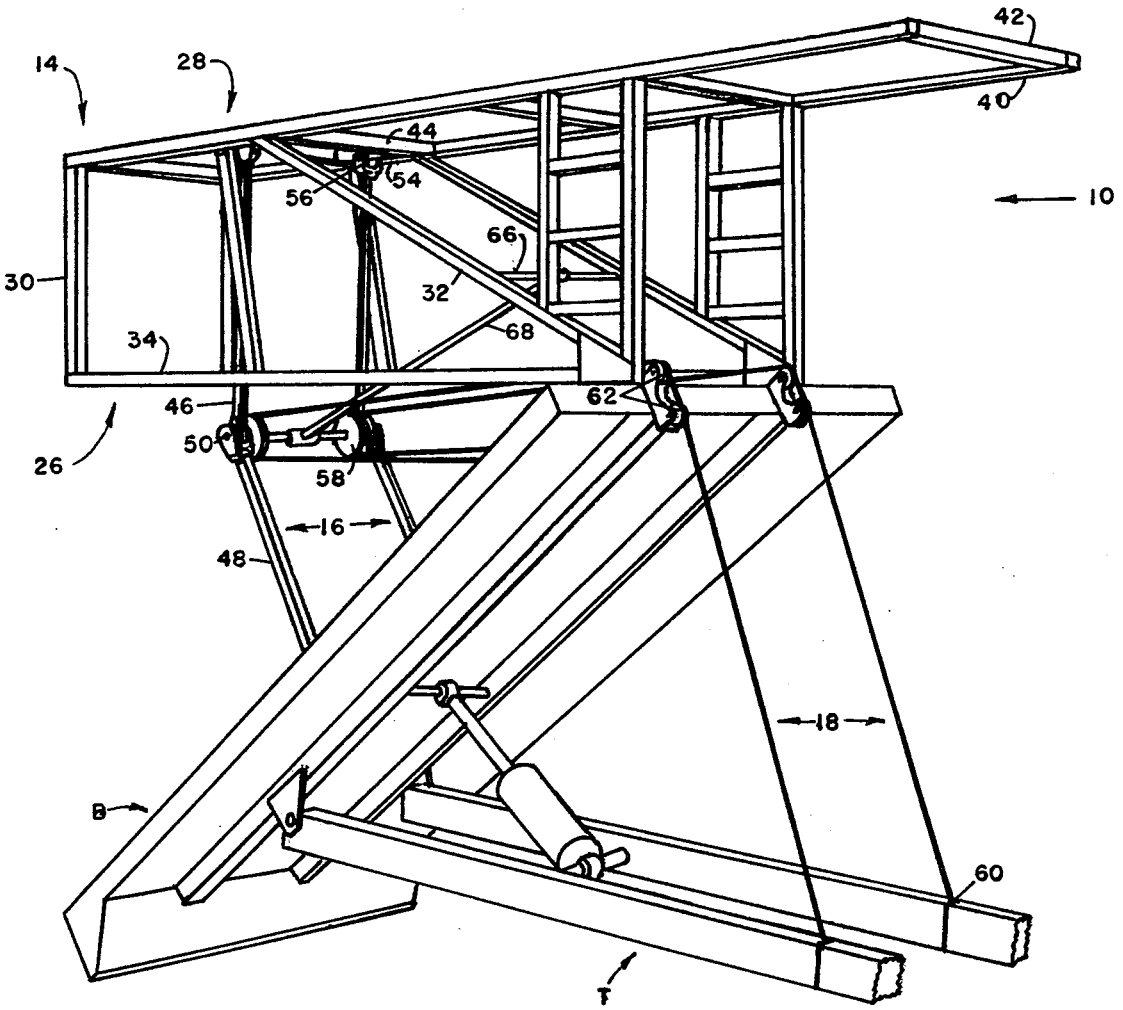
FIG. 3 is another perspective view of a constant level scaffold constructed in accordance with the present invention shown mounted on a portion of a truck chassis carrying a tilting bed.

FIGS. 2 and 3 have been described above. As these drawings represent different views of the same embodiment, like parts in these drawings are indicated with the same numeral as in FIG. 1.

Although the embodiment of this invention, illustrated in the drawings, shows two compression members and two cables to raise the rear of the scaffold platform, other arrangements are possible and within the scope of this invention. For example, additional structural strength can be provided in the region of cross spacers 44 and a cross spacer can be added between side frames 20. A single, centrally-hinged compression member then can be used in the middle of the scaffold unit. A single cable then would be used and could be attached to the truck chassis and side frames 20 by means of bridles or a cross member on the chassis and on the base support structure.

Alternatively, a single cable can be used with double compression members.

Using double compression members is preferred since additional stability of the scaffold platform and freedom from rocking and twisting are obtained without using heavier structural components. Using double cables is preferred since this allows attaching the cables at different points on side frames 20 thus allowing adjustment for uneven terrain as discussed above.

Although not required for operation-of the scaffold of this invention, a safety feature is provided by cross member 66 between diagonal braces 32. Telescoping member 68 having hubs on each end is pivotally coupled on one end to the shaft at pivot point 50 and is pivotally coupled on the other end to cross member 66. This safety feature prevents the centrally hinged compression members 16 from going "over-center" and allowing the sudden, disastrous fall of the rear of the scaffold platform.

Not shown in the drawings, but an additional safety feature can be provided by attaching telescoping legs to the front of the truck bed and to the rear of the bottom side frames of the scaffold platform. After the scaffold is raised, the legs are let down and adjusted to reach the ground. The legs prevent a sudden, disastrous fall of the platform should a hydraulic hose or a cable break.

The constant level scaffold of this invention can be constructed from commonly available structural materials. The drawings show the scaffold to be constructed principally of box tubing of a square cross section. However, other structural shapes can be used such as box tubing of rectangular cross section, pipe, C-channel, I-beams, and the like. An engineer skilled in the art of metal fabrication can easily determine the structural shapes and their sizes and strengths necessary to construct a sturdy, safe scaffold within the embodiments of this invention.

This invention has been discussed in terms of the embodiment adapted for use on a truck with a bed which tilts front end upward. This invention also is readily adaptable for use on trucks having other bed tilting arrangements such as a side tilt bed. For a side tilt truck bed, the scaffold must be constructed with hubs 24 and pins 38 mounted on one side frame rather than mounted on the front end of the side frames.

Thus, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A constant-level scaffold adapted for use with a tilt bed truck comprising:

(a) A base support structure;

(b) Means for securely fastening said base support structure to the bed of a tilt bed truck;

(c) A scaffold platform pivotally connected by a first pivotal connection on one side to said base support structure, said first pivotal connection being adapted and arranged to be adjacent to the side of said truck bed which will rise as said truck bed is tilted;

(d) At least one centrally hinged compression member having a second pivotal connection to said base support structure and a third pivotal connection to said scaffold platform, said hinge of said compression member including a first sheave for the passage therethrough of a flexible line, said compression member positioned such that said central hinge is located in a direction from said second and third pivotal connections opposite from said first pivotal connection and adapted and arranged such that as said central hinge moves toward said first pivotal connection, the angle between said base support structure and said scaffold platform increases; and (e) At least one flexible line attached on one end to said base support structure at a point between said first and said second pivotal connections and passing from said attachment point and bending around said first sheave, reversing direction and passing toward said first pivotal connection and bending around a second sheave located on said base support structure and passing in a direction toward the chassis of said truck for attachment to said chassis, whereby as the truck bed is tilted, the portion of the line between the base support structure and said first sheave decreases and the portion of the line between said first sheave and said second sheave decreases causing the angle between said base support structure and said scaffold platform to increase.

2. A constant level scaffold of claim 1 wherein said centrally-hinged compression member comprises two centrally-hinged compression members pivotally connected on one end to the side frames of said base support structure and pivotally connected on the opposite end to lateral spacers connected to cross spacers connected to the side frames of said scaffold platform, said lateral spacers having the same cross spacing distance as the cross spacing distance between said side frames of said base support structure.

3. A constant-level scaffold of claim 2 wherein said flexible line comprises two flexible lines.

4. A constant level scaffold of claim 3 wherein said flexible line comprises wire rope.

5. A constant-level scaffold of claim 1 wherein said centrally-hinged compression member comprises two centrally-hinged compression members pivotally connected on one end to the side frames of said base support structure and pivotally connected on the opposite end to a cross spacer between the side frames of said scaffold platform.

6. A constant-level scaffold of claim 5 wherein said flexible line comprises two flexible lines.

7. A constant-level scaffold of claim 6 wherein said flexible lines comprise wire rope.

* * * * *